US005378331A

United States Patent [19]

Kemp

[11] Patent Number: 5,378,331

[45] Date of Patent: Jan. 3, 1995

[54] APPARATUS AND METHOD FOR ELECTROPOLISHING METAL WORKPIECES

[75] Inventor: Willard E. Kemp, Houston, Tex.

[73] Assignee: Kemp Development Corporation, Houston, Tex.

[21] Appl. No.: 56,754

[22] Filed: May 4, 1993

[51] Int. Cl.[6] ..... C25F 3/16; C25F 7/00

[52] U.S. Cl. ..... 204/129.7; 204/273; 204/275; 204/278; 204/224 M

[58] Field of Search ..... 204/224 M, 129.1, 129.7, 204/273, 275, 272, 278, 277

[56] References Cited

U.S. PATENT DOCUMENTS 3,658,684 4/1972 Sickels ..... 204/275
3,772,163 11/1973 Jumer ..... 204/212 X
3,841,990 10/1974 Sasaki et al. ..... 204/272 X
4,082,623 4/1978 Musbach ..... 204/213 X
4,082,638 4/1978 Jumer ..... 204/213
4,082,640 4/1978 Haack ..... 204/279
5,135,632 8/1992 Weber ..... 204/224 M

*Primary Examiner*—Donald R. Valentine
*Attorney, Agent, or Firm*—Bush, Moseley & Riddle

[57] ABSTRACT

An apparatus and method especially adapted for electropolishing reactive metal workpieces which require aggressive electrolytes. It incorporates a single, closed, pressure-tight polishing chamber into which metal workpieces are placed for a multi-step operation. All electrolyte cleaning and rinse fluids are pumped in and out of the chamber as required for sequential operations, and vacuum assisted purging and dying removes the electrolyte or polishing residue from the chamber after each step.

8 Claims, 4 Drawing Sheets

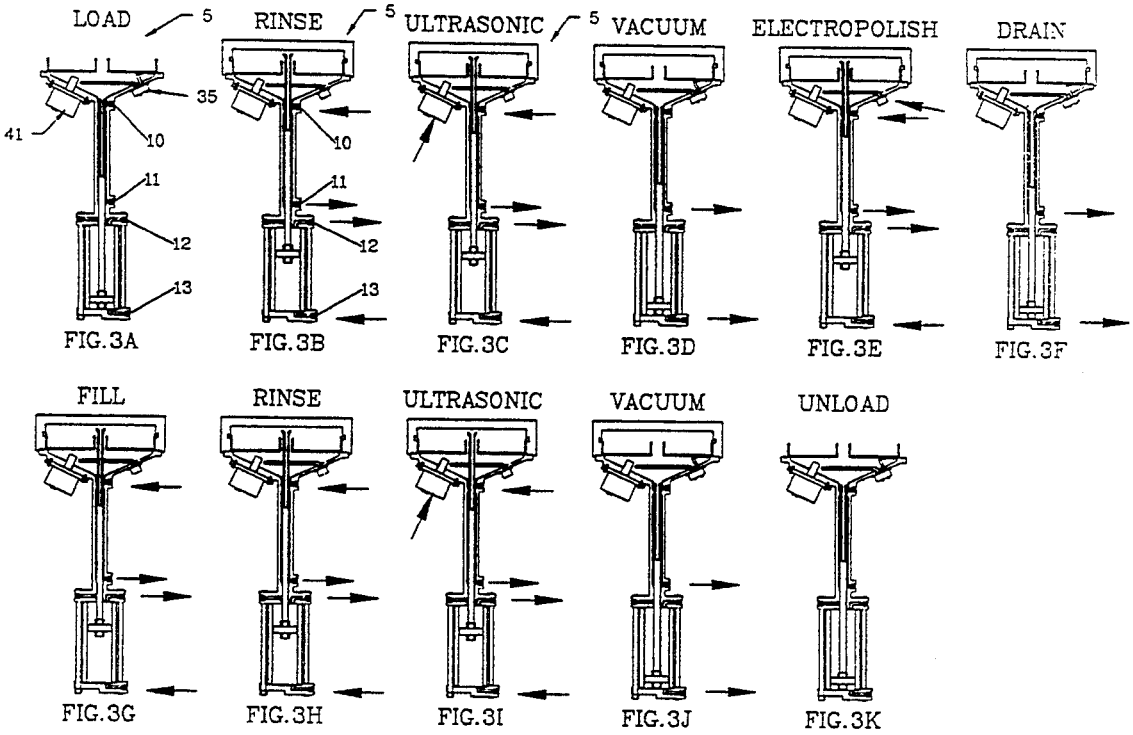
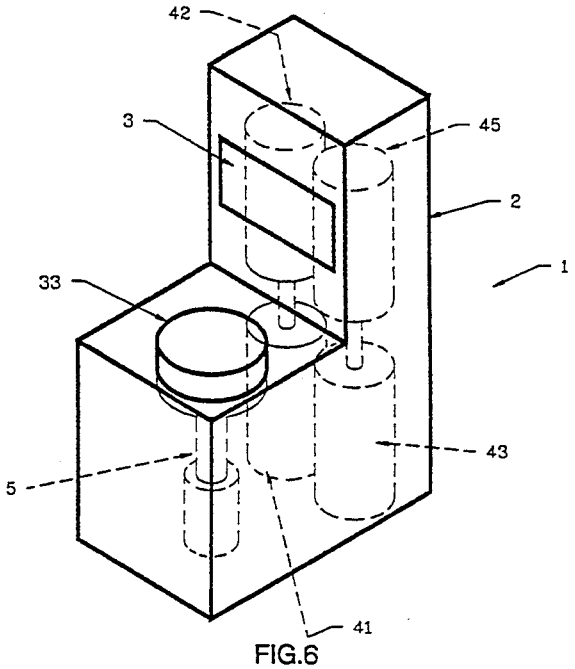
FIG.6

| FUNCTION | COMPONENT POSITION | | | | | | | | | | | | | |
|---|---|---|---|---|---|---|---|---|---|---|---|---|---|---|
| | ULT | E1 | P1 | P2 | VAC | V1 | V2 | V3 | V4 | V5 | V6 | V7 | V8 | V9 |
| SAFETY FUNCTIONS | | | | | | | | | | | | | | |
| S1 SIGNAL | X | X | X | X | O | X | O | O | X | X | X | X | X | O |
| S2 SIGNAL | X | X | X | X | O | X | O | O | X | X | X | X | X | O |
| S3 SIGNAL | X | X | X | X | X | X | O | O | O | X | X | X | X | X |
| OPERATING FUNCTIONS | | | | | | | | | | | | | | |
| LOAD/UNLOAD | X | X | X | X | O | X | O | O | X | X | X | X | X | O |
| RINSE | X | X | X | O | X | O | X | X | O | X | X | O | O | X |
| CLEAN | O | X | X | O | X | O | X | X | O | X | X | O | O | X |
| POLISH | X | O | O | X | X | O | X | X | O | O | O | X | X | X |
| ELECT DRAIN | X | X | O | X | X | X | O | O | X | X | O | X | X | X |
| RINSE DRAIN | X | X | X | O | X | X | O | O | X | X | X | X | O | X |
| VACUUM | X | X | X | X | O | X | O | O | X | X | X | X | X | O |
| OFF | X | X | X | X | X | X | O | O | O | X | X | X | X | O |

FIG. 5

APPARATUS AND METHOD FOR ELECTROPOLISHING METAL WORKPIECES

FIELD OF THE INVENTION

This invention relates to an apparatus and method for electropolishing metal workpieces, and more particularly to such an apparatus and method which performs electropolishing in a chamber sealed from ambient conditions.

BACKGROUND OF THE INVENTION

In any electropolishing system, the basic requirement is to immerse the metal workpiece in an electrolyte and create an electric field between the workpiece and an electrode within that same electrolyte. Surface metal goes into solution and the electrical potential accentuates this metal removal at the micro-peaks where ions have easier access, with less reaction taking place in the micro-valleys where reactions are more difficult. Amperage, voltage and electrolytic concentrations are all adjusted to maximize this differential attack. The result is a chemical removal over the entire surface, but more accentuated in the ridges than in the valleys and resulting in a substantially smoother surface, and eliminating the micro-tearing and grooving which results from mechanical polishing techniques. Micrographic examination of mechanically polished surfaces show some tearing even at very low RMS values whereas electropolished metal surfaces show a complete absence of such features. It is of course, necessary to clean the workpieces thoroughly before immersion in the electrolyte, and then to remove all traces of electrolyte afterwards. A multi-tank system is used in conventional electropolishing. Workpieces or metal parts are first cleaned in one tank, immersed in a second tank to rinse, and then usually moved to a third tank for final rinsing. They are then placed in the electrolyte for polishing. After electropolishing, the workpieces go through as many as three rinse tanks to assure complete removal of all traces of electrolytes.

Electrolytes used in conventional stainless steel electropolishing systems are typically sulfuric and chromic acids, and open tanks must be carefully vented. Any discharge of such electrolytes must be treated prior to disposal of liquids into a sanitary system. Proper venting, proper treatment of liquid discharge, protective equipment for workers, and the isolation of facilities have made electropolishing relatively safe for stainless steels.

For titanium dental and orthopaedic implants and other components made from reactive metals, there are several serious shortcomings to existing systems since medical implant components are relatively small with low production rates and since the electrolytes required for titanium are hydrofluoric, acetic or perchloric acid based. These acids represent serious additional hazards for open tank systems. Multi-tank systems are seldom smaller than a 50 gallon size for each individual tank. This represents a sizable investment in the electrolyte, a sizable quantity involved from an environmental standpoint, and a sizable surface area from which fuming can occur.

It is technically feasible to build a smaller version of a conventional multi-tank system for titanium implants by incorporating the necessary environmental and personal safeguards. However, such a system would be costly and could not be operated in a shop or lab environment without extensive ventilation and utility modifications. An entirely new approach has been designed in the present system and several new capabilities have also been incorporated which are not available in conventional systems heretofore.

SUMMARY OF INVENTION

In the design of the apparatus and method comprising the present invention, the primary design criteria included the following: (1) minimizing the total quantity of electrolyte in use so that personal exposure is minimized and frequent replacement is economically feasible; (2) eliminating entirely the emission of electrolyte fumes or liquids by having all electrolytes totally contained at all times and never exposed to the atmosphere; (3) utilizing a "modular" system for service or replacement of electrolyte and related chemical processing devices; (4) eliminating any handling except for initial loading and unloading of workpieces; (5) minimizing local hook up requirements to electrical power, cold water supply and ordinary sewage disposal; (6) providing a failure mode of the system which results in a non-hazardous shut down of the equipment; and (7) incorporating pulse-reverse capability and ultrasonic stirring capability.

For operation of the apparatus, the workpieces are placed in a sealed work chamber and a computer-controlled plumbing system is utilized with the apparatus to sequentially rinse, polish and clean the workpieces by bringing various liquids, including electrolytes, into the chamber and evacuating them after each cycle.

The apparatus for electropolishing a metal workpiece comprises a polishing chamber sealed from ambient conditions, at least one electrolyte holding chamber which is sealed from ambient conditions, an electrolyte fume removal means in communication with the electrolyte holding chamber, at least one rinse fluid holding chamber which is sealed from ambient conditions, an exhaust pipe movable between an uppermost position and a lowermost position in the polishing chamber, electrical means capable of creating an electrical potential between the workpiece and an electrode within the polishing chamber for creating a current within the electrolytic fluid when the electrolytic fluid has been transferred into the polishing chamber from the electrolyte holding chamber, and fluid control means to sequentially transfer electrolyte and rinse fluids from the electrolyte holding chamber and the rinse fluid holding chamber into the polishing chamber and out of said polishing chamber through the exhaust pipe, the fluid control means including means to create a negative pressure within the polishing chamber during and after withdrawing the fluids through the exhaust pipe when the exhaust pipe is in its lowermost position.

The improved method of this invention for electropolishing the metal workpiece comprises the steps of placing the workpiece in a chamber which is sealed from the atmosphere; contacting the workpiece with an electrode of a current source to form an electrode from the workpiece; providing a second electrode attached to a second lead of the current source; pumping rinse fluid into the chamber to a level at least partially above the level of the workpiece therein and circulating the rinse fluid through said chamber; withdrawing the rinse fluid from the chamber and then creating a negative pressure in the chamber to provide withdrawal of the rinse fluid, then introducing an electrolytic fluid into the chamber; activating the electrodes through the current source to facilitate electrochemical smoothing of the surface of said workpiece; and withdrawing the electrolytic fluid from the chamber and subjecting said chamber to negative pressure to assist in evacuation of said electrolytic fluid.

BRIEF DESCRIPTION OF DRAWINGS

FIGS. 3A through 3K show in sequence the steps involved in the electropolishing process for the electropolishing chamber with arrows indicating the direction of fluid flow or the presence of electric power for the various steps in the electropolishing process;

FIG. 5 is a table illustrating the related valve and electrical positions (x=off, o=on) for the various functions achieved in the apparatus shown in FIGS. 1A–4: and FIG. 6 is a perspective view, largely schematic of the electropolishing chamber shown in FIG. 1A mounted within an apparatus for operation of the entire process for electropolishing a metal workpiece automatically within a sealed pressure type apparatus.

DESCRIPTION OF THE INVENTION

The deactivator and the electrolyte container are sealed units to be removed and replaced on a regular basis by specialized personnel, an operation that may take place once a week if frequently used, or perhaps once a month in a unit not subject to frequent use. In any case, there is no need for operating personnel to have any contact whatsoever with any electrolyte or deactivator fluids. The electric power for electropolishing can be "pulsed" from positive to negative values at rates up to 60 cycles per second or more. The rapid reversing of current aids in achieving uniformity of polish.

Figure 2:
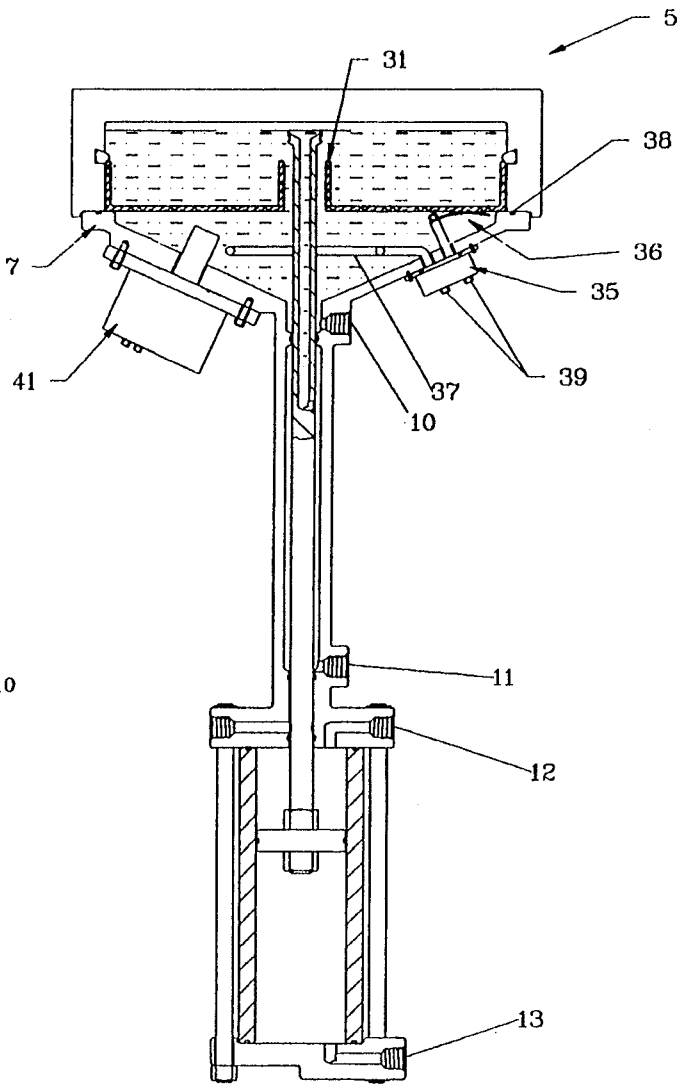
FIGS. 1A, 1B and 2 illustrate the electropolishing chamber comprising the apparatus of the present invention.
Figure 1B:
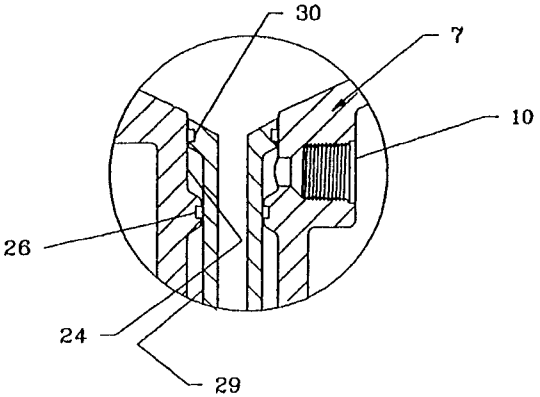
Figure 1A:
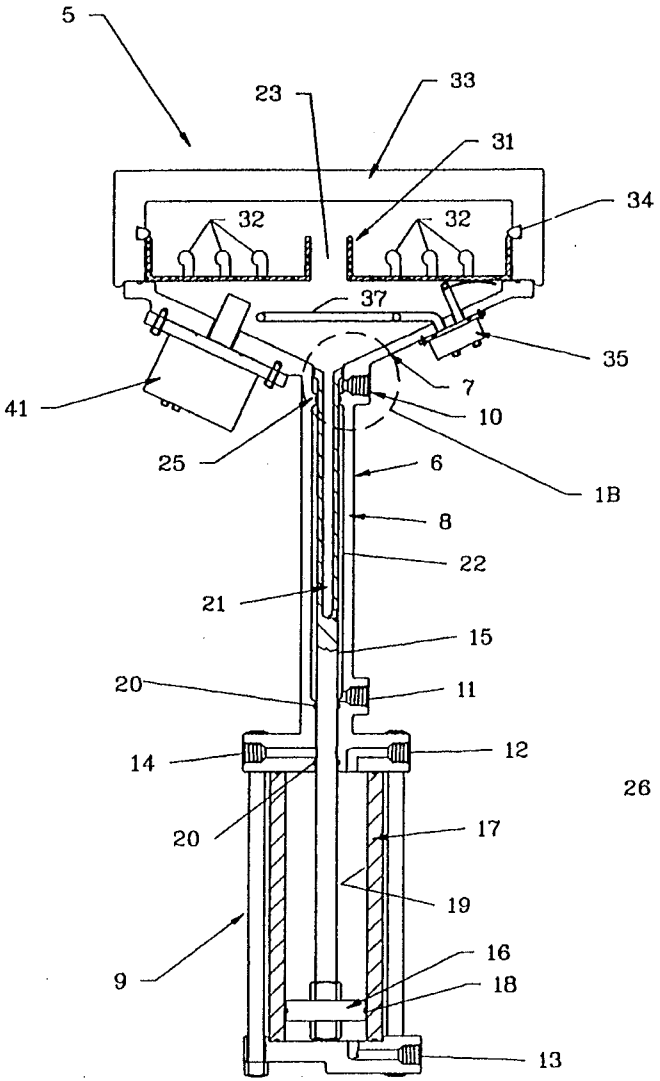

In FIGS. 1A and 2, an electropolishing chamber 5 is shown in two operating positions, as will be explained hereafter. Electropolishing chamber 5 comprises a housing 6 including a bowl section 7, a columnar section 8, and an actuator section 9. Housing 6 contains an exhaust port 10, an inlet port 11, vacuum ports 12 and 13 and test port 14. An exhaust tube or pipe 15 is activated by a piston 16 mounted within cylinder 17 and urged by an applied vacuum to ports 12 and 13 to move exhaust pipe 15 from the position shown in FIG. 1A to that shown in FIG. 2. Piston 16 has seal 18 bearing against an inner wall 19 of cylinder 17. A seal 20 seals against the outside of exhaust tube 15 so that vacuum forces may be used to reciprocate exhaust tube 15 between upper and lower positions. Within exhaust tube 15 is a passageway 21 communicating with annular space 22 and thence to exhaust port 11 so as to draw fluids from bowl interior 23 through passage 21 into annular chamber 22 and out exhaust port 11.

Exhaust tube 15 has an enlarged section at its upper end, containing a seal 30 which engages surface 24 of bowl section 7 when the exhaust tube is in the lower position. Columnar section 8 of housing 6 contains a raised seal area 25 containing seal 26 which bears against the outer surface 29 of exhaust pipe 15. It can be seen that when exhaust pipe 15 is in its lower position, fluids can be drawn from bowl area 23 to the extent a negative pressure can be maintained in chamber 23 when exhaust pipe 15 is in the lower position. When exhaust pipe 15 is in the upper position, fluid can readily flow into port 10, filling bowl area 23 to the level indicated in FIG. 2. Fluids are then drawn through port 21 of exhaust pipe 15 into annular chamber 22 and out exhaust port 11 and can be continually circulated therein as desired. Test port 14 allows individual testing and verification of seals 20 to assure no entry of electrolyte or rinse fluids into the vacuum system in case of failure of the seals.

Mounted on housing 6 is support tray 31 made of a conductive material and containing workpieces 32 therein in an electrically connected manner. Bonnet 33 encloses tray 31 and holds it down against housing 6 by means of elastomer ring 34. A seal 38 mounted on housing 6 seals bonnet 33. Also mounted to bowl 7 is electric power unit 35 having power connections 39, and flexible contact 36 making flexible contact with support tray 31, and electrode 37 extending into the interior 23 of bowl 7. Ultrasonic stirrer 41 is mounted on bowl 7 for selective vibration of the electrolyte.

Figure 4:
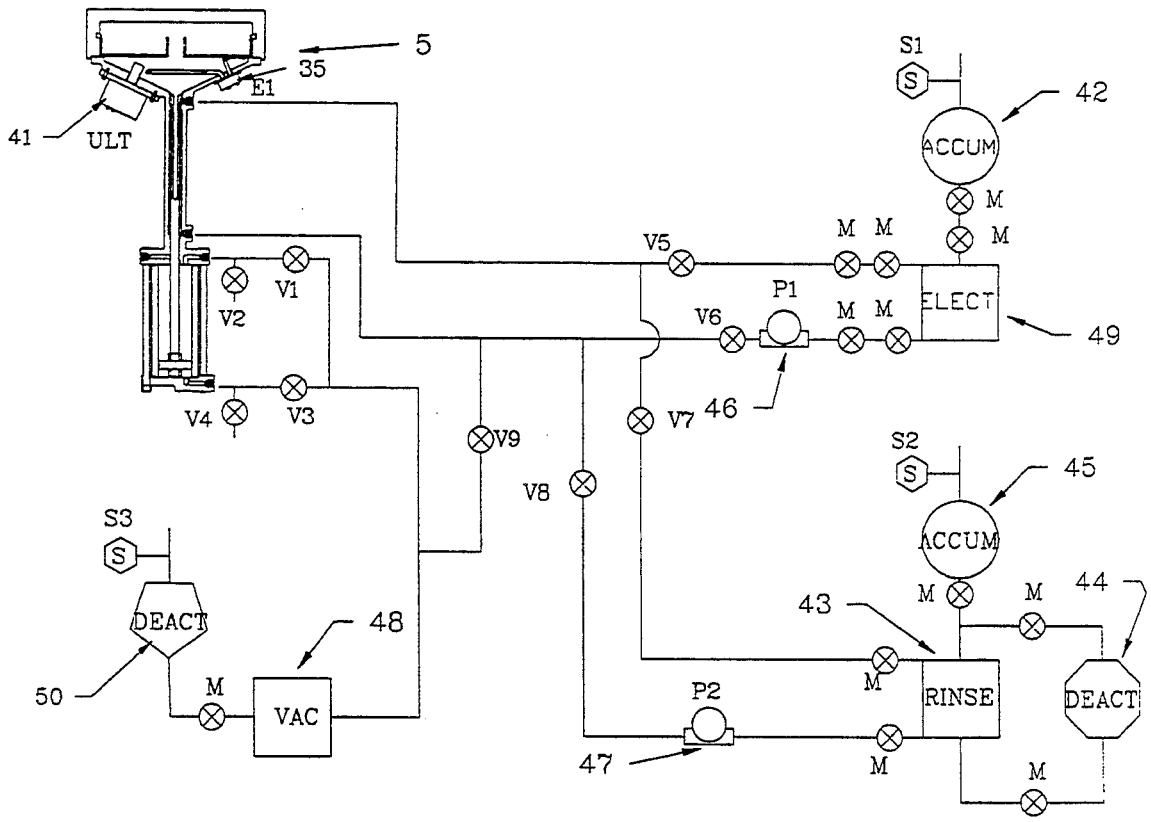
FIG. 4 is a schematic of the plumbing system for the apparatus shown in FIGS. 1A and 2.

Referring now to FIG. 4 which shows schematically the electropolishing chamber 5 in relationship to an electrolyte holding chamber 49, a fume control device 42, rinse water holding chamber 43, rinse water deactivating chamber 44, rinse water accumulating chamber 45, pumps 46 and 47, vacuum pump 48 and deactivating chamber 50. Further, on FIG. 4 is current means 35 with electrical connection shown as E1, and an ultrasonic stirrer 41 with electrical connection denoted as ULT. Also shown are valves V1 through V9, sensors S1 through S3, electric power to pumps denoted as P1 and P2, and various manually set valves denoted as M.

FIGS. 3A through 3K shows the sequential operating positions of the polishing chamber. FIGS. 3A through 3K also shows by means of arrows the direction of fluid flow from the ports and the presence of electrical power to ultrasonic stirrer 41 and the electropolishing electrodes. FIG. 5 shows the valve and electrical conditions for the performance of various functions with x denoting closed and o denoting an open condition.

FIG. 3A shows the system at rest with the bonnet removed for loading. Referring to FIG. 5, the function is "OFF" and all valves are in their failure position. All valves and electrical connections fail in "OFF" position except V2, V3, V4 and V9 which fail in the open mode.

FIG. 3B is a "Rinse" position, wherein rinse fluid enters the port 10 and exits port 11. Vacuum is applied to port 12 and port 13 is open to atmosphere. Referring to FIGS. 4 and 5, operating function "Rinse" shows that pump P2 is on and rinse water is circulated from polishing chamber 5 to rinse tank 43 via pump 47 and open valves V7 and V8. Valve V4 is open to atmosphere and valves V2 and V3 are closed. Vacuum is applied by pump 48 through valve V1 to the upper side of piston 16, moving exhaust pipe 15 into the upper position.

FIG. 3C shows the position of the electropolishing chamber for a "Clean" cycle. The pumps and valves are in the same position as for "Rinse". Now the ultrasonic power ULT is ON. After completion of ultrasonic cleaning, the polishing chamber is placed in the "Drain" mode as shown in FIG. 3F, and referring to FIG. 5 it is shown that pump P2 is ON, valve V2 has been opened, and valve V3 is opened so that vacuum from pump 48 moves exhaust tube 15 to its lowermost position. Valve V8 is open but valve V7 is closed so that fluids are evacuated from chamber 23 and a negative pressure is created therein. It should be noted also that when exhaust pipe 15 is in the lower position, as shown in FIG. 1A, seal 30 engages seal surface 24 to serve as a primary means of assuring that no fluids may enter through port 10 while exhaust pipe 15 is down. After the rinse and drain operation, vacuum may be further applied by turning vacuum pump on and closing valve V8 and opening valve V9.

FIG. 3E shows the "Polish" position with the current going to the electrode. The exhaust pipe is in the upper position and fluid now circulates from the polishing chamber through the electrolyte holding chamber.

Referring to FIGS. 4 and 5 under the function "Polish", power is applied to the electrode unit 35, pump P1 is ON along with valves V1, V4, V5 and V6. Other steps are believed to be self-explanatory.

Accumulator 42 over electrolyte holding tank 41 allows for the liquid level in the electrolyte holding tank to fluctuate through expansion or contraction of gas in accumulator 42. Accumulator 42 also contains means to deactivate acids or other toxic materials contained in the atmosphere to provide a fume control.

Sensor S1 detects the presence of such potentially toxic compounds and if they are present it shuts the pump down, lowers the exhaust pipe and applies vacuum as indicated in FIG. 5 under "safety function". Deactivation means 44 circulates fluids through the rinse water tank 43 to remove any trace elements arising from the operation. Accumulator 45 allows for level changes of fluids in the rinse water and deactivating chamber by means of a gas in accumulator 45. Sensor S2 detects the presence of toxic materials emitting from accumulator 45 and if present will shut the system off as indicated in FIG. 5 under "safety function".

Deactivating chamber 50 is connected in series to vacuum pump 48 so that any vacuum gases are thereby cleaned before entering the atmosphere. If toxic materials are detected emanating from deactivating chamber 50, sensor S3 will cause the system to shut down. As indicated in FIG. 5 under "safety functions" the various valve positions for the "S3 signal" are the same as for S1 and S2 signals except that the vacuum pump is also shut down for the S3 signal. Valves denoted by the symbol M are for replacement or maintenance of equipment and are not operated during normal functions.

Referring to FIG. 6, all components are contained in cabinet 1 consisting of enclosure 2 having a control panel 3 and a transparent bonnet 33 under which the metal workpieces 32 are inserted for processing and through which the operation can be viewed. Contained within cabinet 1 are major components: the electropolishing chamber 5, an electrolyte chamber 41, a rinse tank or chamber 43, an accumulator 42 providing a fume control device, and a rinse fluid accumulating chamber 45.

Description of the Electropolishing System

FIGS. 3A through 3K show the basic operating sequence of the electropolishing chamber. The arrows directed at ports 10, 11, 12 and 13 indicate the direction of fluid flow and the arrows at power unit 35 and ultrasonic stirrer 41 indicate the presence of electric power.

First, as illustrated in FIG. 3A, bonnet 33 is removed with exhaust tube 15 down, and metal workpieces 32 are loaded onto tray 31. Bonnet 33 is then replaced. Then, exhaust tube 15 is raised as in FIG. 3B and the rinse fluids enter the upper inlet port 10 and are exhausted through exhaust tube 15. With exhaust tube 15 still raised, ultrasonic vibration is applied by stirrer 41 to thoroughly clean the workpieces as shown in FIG. 3C. Exhaust tube 15 is then lowered as in FIG. 3D to block inlet fluids and to allow a vacuum to be created beneath bonnet 33.

Exhaust tube 15 is next raised in accord with FIG. 3E. Fluid again circulates in the inlet and out the outlet. This time the fluid contains electrolytes and the electropolishing electrodes are activated.

Exhaust tube 15 is then lowered as shown in FIG. 3F creating a vacuum under bonnet 33 to assist in draining of the electrolytes. As shown in FIG. 3G, exhaust tube 15 is raised, allowing rinse fluids to circulate beneath bonnet 33. After rinsing, exhaust tube 15 is lowered again and fluids are pumped under vacuum to the rinse tank 43. Then, as shown in FIG. 3H, a second rinse is employed.

Next, as illustrated in FIG. 31, exhaust tube 15 is raised and fluids are circulated while ultrasonic vibrations from stirrer 41 are utilized to assure all electrolyte is cleaned from the workpieces. Exhaust tube 15 is lowered as shown in FIG. 3J and a vacuum is drawn onto bonnet 33 to assure complete removal of all liquids of any kind. Finally as shown in FIG. 3K, bonnet 33 is again removed and the finished workpieces are removed from tray 31.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A device for electropolishing a metal workpiece comprising:

a polishing chamber adapted to be sealed from atmosphere and capable of withstanding a negative pressure;

at least one electrolyte holding chamber sealed from atmosphere and adapted for controlled bi-directional fluid communication with said polishing chamber;

at least one rinse fluid holding chamber which is sealed from atmosphere and adapted for controlled bi-directional fluid communication with said polishing chamber;

means for selectively introducing rinse fluids and electrolyte fluids within said polishing chamber;

an exhaust conduit movable between an upper position and a lower position in said polishing chamber, said conduit in the upper position drawing fluid from said polishing chamber at a predetermined high fluid level for said polishing chamber, said exhaust conduit in its lower position drawing fluid from a predetermined low fluid level in said polishing chamber and simultaneously blocking fluids from entering said polishing chamber;

means to hold said workpiece at least partially beneath the surface of said selected fluids when in said polishing chamber;

electrical means capable of creating an electrical potential between two electrodes for creating a current within said electrolyte fluid when said electrolyte fluid has been transferred into said polishing chamber from said electrolyte holding chamber, said workpiece defining one of said electrodes, said polishing chamber having the other electrode therein adapted for contact with said electrolyte fluid; and fluid control means to sequentially transfer electrolyte and rinse fluids from said electrolyte holding chamber and said rinse fluid holding chamber into said polishing chamber and out of said polishing chamber through said exhaust conduit, said fluid control means including means to create a negative pressure within said polishing chamber during and after withdrawing said fluids through said exhaust conduit when said exhaust conduit is in its lowermost position.

2. A device for electropolishing a metal workpiece comprising:

a polishing chamber adapted to be sealed from atmosphere and capable of withstanding a negative pressure;

at least one electrolyte holding chamber sealed from atmosphere and adapted for controlled bi-directional fluid communication with said polishing chamber;

at least one rinse fluid holding chamber which is sealed from atmosphere and adapted for controlled bi-directional fluid communication with said polishing chamber;

means for selectively introducing rinse fluids and electrolyte fluids within said polishing chamber;

an exhaust conduit movable between an upper position and a lower position in said polishing chamber, said conduit in the upper position drawing fluid from said polishing chamber at the maximum fluid level desired for said polishing chamber, said exhaust conduit in its lower position drawing fluid from the lowest point in said polishing chamber and simultaneously blocking fluids from entering said polishing chamber;

means to hold said workpiece at least partially beneath the surface of said selected fluids when in said polishing chamber;

electrical means capable of creating an electrical potential between two electrodes for creating a current within said electrolyte fluid when said electrolyte fluid has been transferred into said polishing chamber from said electrolyte holding chamber, said workpiece defining one of said electrodes, said polishing chamber having the other electrode therein adapted for contact with said electrolyte fluid;

fluid control means to sequentially transfer electrolyte and rinse fluids from said electrolyte holding chamber and said rinse fluid holding chamber into said polishing chamber and out of said polishing chamber through said exhaust conduit, said fluid control means including means to create a negative pressure within said polishing chamber during and after withdrawing said fluids through said exhaust conduit when said exhaust conduit is in its lowermost position; and electrolyte fume removal means in communication with said electrolyte holding chamber for removing vapor and fluid droplets from atmospheres emanating from said electrolyte holding chamber so that gas passing through said fume removal means contains safe breathable gases.

3. A device for electropolishing a metal workpiece comprising:

a polishing chamber adapted to be sealed from atmosphere and capable of withstanding a negative pressure;

at least one electrolyte holding chamber sealed from atmosphere and adapted for controlled bi-directional fluid communication with said polishing chamber;

at least one rinse fluid holding chamber which is sealed from atmosphere and adapted for controlled bi-directional fluid communication with said polishing chamber;

means for selectively introducing rinse fluids and electrolyte fluids within said polishing chamber;

an exhaust conduit movable between an upper position and a lower position in said polishing chamber, said conduit in the upper position drawing fluid from said polishing chamber at the maximum fluid level desired for said polishing chamber, said exhaust conduit in its lower position drawing fluid from tile lowest point in said polishing chamber and simultaneously blocking fluids from entering said polishing chamber;

means to hold said workpiece at least partially beneath the surface of said selected fluids when in said polishing chamber;

electrical means capable of creating an electrical potential between two electrodes for creating a current within said electrolyte fluid when said electrolyte fluid has been transferred into said polishing chamber from said electrolyte holding chamber, said workpiece defining one of said electrodes, said polishing chamber having the other electrode therein adapted for contact with said electrolyte fluid;

fluid control means to sequentially transfer electrolyte and rinse fluids from said electrolyte holding chamber and said rinse fluid holding chamber into said polishing chamber and out of said polishing chamber through said exhaust conduit, said fluid control means including means to create a negative pressure within said polishing chamber during and after withdrawing said fluids through said exhaust conduit when said exhaust conduit is in its lowermost position; and ultrasonic stirring means mounted in communication with fluids within said polishing chamber.

4. A device for electropolishing a metal workpiece comprising:

a polishing chamber adapted to be scaled from atmosphere and capable of withstanding a negative pressure;

at least one electrolyte holding chamber sealed from atmosphere and adapted for controlled bi-directional fluid communication with said polishing chamber;

at least one rinse fluid holding chamber which is sealed from atmosphere and adapted for controlled bi-directional fluid communication with said polishing chamber;

means for selectively introducing rinse fluids and electrolyte fluids within said polishing chamber;

an exhaust conduit movable between an upper position and a lower position in said polishing chamber, said conduit in the upper position drawing fluid from said polishing chamber at the maximum fluid level desired for said polishing chamber, said exhaust conduit in its lower position drawing fluid from the lowest point in said polishing chamber and simultaneously blocking fluids from entering said polishing chamber;

means to hold said workpiece at least partially beneath the surface of said selected fluids when in said polishing chamber;

electrical means capable of creating an electrical potential between two electrodes for creating a current within said electrolyte fluid when said electrolyte fluid has been transferred into said polishing chamber from said electrolyte holding chamber, said workpiece defining one of said electrodes, said polishing chamber having the other electrode therein adapted for contact with said electrolyte fluid;

fluid control means to sequentially transfer electrolyte and rinse fluids from said electrolyte holding chamber and said rinse fluid holding chamber into said polishing chamber and out of said polishing chamber through said exhaust conduit, said fluid control means including means to create a negative pressure within said polishing chamber during and after withdrawing said fluids through said exhaust conduit when said exhaust conduit is in its lowermost position;

a vent in said rinse fluid holding chamber; and sensing means in said vent to detect the presence in said vent of trace quantities of electrolyte fluids.

5. A device for electropolishing a metal workpiece comprising:

a polishing chamber adapted to be sealed from the atmosphere and capable of withstanding pressure;

at least one electrolyte holding chamber sealed from the atmosphere and adapted for controlled bi-directional fluid communication with said polishing chamber;

at least one rinse fluid holding chamber which is sealed from atmosphere and adapted for controlled bi-directional fluid communication with said polishing chamber;

means for selectively introducing a rinse fluid and an electrolyte fluid within said polishing chamber;

means to hold said workpiece at least partially beneath the surface of said fluids when in said polishing chamber;

electrical means capable of creating an electrical control between two electrodes for creating a current within said electrolyte fluid when said electrolyte fluid has been transferred into said polishing chamber from said electrolyte chamber, said workpiece defining one of said electrodes, said polishing chamber having the other electrode therein adapted for contact with said electrolyte fluid;

fluid control means to sequentially transfer electrolyte and rinse fluids from said electrolyte holding chamber and said rinse fluid holding chamber into said polishing chamber and out of said polishing chamber; and electrolyte fume removal means in communication with said electrolyte holding chamber for removing vapor and fluid droplets from atmosphere emanating from said electrolyte holding chamber so that gas exhausting from said removal means contains safe, breathable gas.

6. A device for electropolishing a metal workpiece comprising:

a polishing chamber adapted to be sealed from the atmosphere and capable of withstanding pressure or vacuum;

at least one electrolyte holding chamber sealed from the atmosphere and adapted for controlled bi-directional fluid communication with said polishing chamber;

at least one rinse fluid holding chamber which is sealed from atmosphere and adapted for controlled bi-directional fluid communication with said polishing chamber;

means for selectively introducing a rinse fluid and an electrolyte fluid within said polishing chamber;

means to hold said workpiece at least partially beneath the surface of said fluids when in said polishing chamber;

electrical means capable of creating an electrical control between two electrodes for creating a current within said electrolyte fluid when said electrolyte fluid has been transferred into said polishing chamber from said electrolyte chamber, said workpiece defining one of said electrodes, said polishing chamber having the other electrode therein adapted for contact with said electrolyte fluid;

fluid control means to sequentially transfer electrolyte and rinse fluids from said electrolyte holding chamber and said rinse fluid holding chamber into said polishing chamber and out of said polishing chamber; and ultrasonic stirring means mounted to communicate vibrations into fluids within said polishing chamber.

7. A device for electropolishing a metal workpiece comprising:

a polishing chamber adapted to be sealed from the atmosphere and capable of withstanding pressure;

at least one electrolyte holding chamber sealed from the atmosphere and adapted for controlled bi-directional fluid communication with said polishing chamber;

at least one rinse fluid holding chamber which is sealed from atmosphere and adapted for controlled bi-directional fluid communication with said polishing chamber;

means for selectively introducing a rinse fluid and an electrolyte fluid within said polishing chamber;

means to hold said workpiece at least partially beneath the surface of said fluids when in said polishing chamber;

electrical means capable of creating an electrical control between two electrodes for creating a current within said electrolyte fluid when said electrolyte fluid has been transferred into said polishing chamber from said electrolyte chamber, said workpiece defining one of said electrodes, said polishing chamber having the other electrode therein adapted for contact with said electrolyte fluid;

fluid control means to sequentially transfer electrolyte and rinse fluids from said electrolyte holding chamber and said rinse fluid holding chamber into said polishing chamber and out of said polishing chamber;

a vent in said rinse fluid holding chamber; and sensing means in said vent to detect the presence in said vent of trace quantities of electrolyte fluid.

8. A method for electropolishing a metal workpiece comprising:

placing said workpiece in a chamber sealed from atmosphere and capable of withstanding pressure or vacuum;

contacting said workpieces with one electrode of a current source to form an electrode of said workpiece;

providing a second electrode attached to a second lead of the current source;

pumping rinse fluid into said chamber to a level at least partially above the level of said workpiece therein and circulating said rinse fluid through said chamber;

withdrawing said rinse fluid from said chamber and then creating a negative pressure in said chamber to withdraw said rinse fluid and to assist in drying of said workpiece;

introducing an electrolyte fluid into said chamber;

activating said electrodes through said current source to facilitate electrochemical smoothing of the surface of said workpiece;

ultrasonically stirring said electrolyte fluid while said electrodes are activated by said current;

withdrawing said electrolyte fluid from said chamber and subjecting said chamber to negative pressure to assist in evacuation of said electrolyte fluid;

introducing said rinse fluid into said chamber and maintaining circulation of said rinse fluid therein for a period of time; and withdrawing said rinse fluid from said chamber and subjecting said chamber to a partial vacuum to assist in evaporation of said rinse fluids.

* * * * *